US006095799A

United States Patent [19]

McDonough et al.

[11] Patent Number: 6,095,799

[45] Date of Patent: Aug. 1, 2000

[54] UTILITY LIGHTER

[75] Inventors: James M. McDonough, Guilford; Daniel A. Ferrara, Bantam; F. Nicolas Garoffolo, Westport; Chris A. Barone, Trumbull; Floyd B. Fairbanks, Naugatuck, all of Conn.

[73] Assignee: BIC Corporation, Milford, Conn.

[21] Appl. No.: 09/332,194

[22] Filed: Jun. 14, 1999

Related U.S. Application Data

[62] Division of application No. 08/787,399, Jan. 22, 1997, Pat. No. 5,934,895.

[51] Int. Cl.[7] ..... F23Q 7/12

[52] U.S. Cl. ..... 431/255; 431/254; 431/344; 431/258

[58] Field of Search ..... 431/255, 344, 431/358, 266, 254

[56] References Cited

U.S. PATENT DOCUMENTS

| | | | |
|---|---|---|---|
| D. 337,839 | 7/1993 | Zeller | D26/43 |
| D. 345,489 | 3/1994 | Moh | D7/416 |
| D. 362,313 | 9/1995 | Zeller | D26/43 |
| 3,520,647 | 7/1970 | Poppel | 431/254 |
| 3,580,698 | 5/1971 | Goto | 431/255 |
| 3,894,273 | 7/1975 | Newport, Jr. et al. | 317/96 |
| 3,947,731 | 3/1976 | Vainer | 317/81 |
| 4,069,006 | 1/1978 | Jackson | 431/344 |
| 4,220,443 | 9/1980 | Bear | 431/91 |
| 4,253,818 | 3/1981 | Ogawa et al. | 431/142 |
| 4,253,820 | 3/1981 | Jarreau | 431/344 |
| 4,259,059 | 3/1981 | Roosa et al. | 431/254 |
| 4,273,528 | 6/1981 | Göbelt | 431/255 |
| 4,288,209 | 9/1981 | Yoshinaga | 431/255 |
| 4,292,021 | 9/1981 | Miyagawa | 431/13 |
| 4,389,187 | 6/1983 | Sims | 431/277 |
| 4,403,946 | 9/1983 | Kagawa | 431/255 |
| 4,462,791 | 7/1984 | Hayden | 431/345 |
| 4,516,933 | 5/1985 | Buzzi | 431/255 |
| 4,538,983 | 9/1985 | Zeller et al. | 431/255 |
| 4,569,654 | 2/1986 | Borghes | 431/255 |
| 4,610,624 | 9/1986 | Bruhn | 431/255 |

(List continued on next page.)

FOREIGN PATENT DOCUMENTS

| | | |
|---|---|---|
| 0 732 545 A1 | 9/1996 | European Pat. Off. . |
| 1 025 122 | 10/1954 | Germany . |
| 54-36882 | 8/1977 | Japan . |
| 54-159069 | 5/1978 | Japan . |
| 61-143620 | 10/1985 | Japan . |
| 64-10027 | 7/1987 | Japan . |
| 2036387 | 5/1995 | Russian Federation . |

OTHER PUBLICATIONS

Supermatch FLX Operating Instructions and Warranty for Model 10504, Zelco Products, 2 pages, Copyright 1994.

*Primary Examiner*—Larry Jones
*Attorney, Agent, or Firm*—Pennie & Edmonds LLP

[57] ABSTRACT

An utility lighter including a housing having a handle at one end and a nozzle at another end and including a fuel supply connected for selective fluid communication with the nozzle. An ignitor assembly, such as a piezoelectric mechanism, is operatively connected to the housing for generating a spark proximate the nozzle and an actuating assembly is connected to the housing proximate the handle and operates to both dispense fuel from the fuel supply and to activate the ignitor assembly. A latch member is operatively connected with the handle and includes a blocking portion connected for biased movement relative to the actuating assembly. The latch member is normally biased into engagement with the actuating assembly to prevent operative movement except when the user moves the latch member against the bias. When the latch member is moved out of engagement with the actuating assembly by the user, a trigger may be pulled to release fuel and initiate a spark at the nozzle. In another aspect, the piezoelectric element includes a contact directly contacting an electrically conductive portion of the housing extending generally between the piezoelectric mechanism and the nozzle. A spark is thereby generated between the electrically conductive housing and the nozzle to ignite a flame.

11 Claims, 4 Drawing Sheets

U.S. PATENT DOCUMENTS

| | | | |
|---|---|---|---|
| 4,635,382 | 1/1987 | Bourdeau | 34/97 |
| 4,691,691 | 9/1987 | Patenaude | 126/414 |
| 4,699,123 | 10/1987 | Zaborowski | 126/409 |
| 4,778,380 | 10/1988 | Nitta | 431/255 |
| 4,854,859 | 8/1989 | Lin | 431/344 |
| 4,919,111 | 4/1990 | Ohsawa | 126/25 B |
| 5,059,852 | 10/1991 | Meury | 310/339 |
| 5,092,764 | 3/1992 | McDonough et al. | 431/277 |
| 5,135,388 | 8/1992 | Pettit | 431/254 |
| 5,154,601 | 10/1992 | Capilla | 431/255 |
| 5,222,889 | 6/1993 | Hsu | 431/255 |
| 5,262,697 | 11/1993 | Meury | 310/336 |
| 5,284,439 | 2/1994 | Shike et al. | 431/263 |
| 5,322,433 | 6/1994 | Shike et al. | 431/266 |
| 5,326,256 | 7/1994 | Shike et al. | 431/255 |
| 5,427,522 | 6/1995 | McDonough et al. | 431/153 |
| 5,460,521 | 10/1995 | Tsai | 431/255 |
| 5,478,232 | 12/1995 | Dillinger et al. | 431/255 |
| 5,496,169 | 3/1996 | Chen | 431/153 |
| 5,505,614 | 4/1996 | Lin | 431/143 |
| 5,531,592 | 7/1996 | Tasi | 431/255 |
| 5,545,035 | 8/1996 | Tsai | 431/255 |
| 5,564,918 | 10/1996 | Lin | 431/255 |
| 5,564,919 | 10/1996 | Tsai | 431/255 |
| 5,616,022 | 4/1997 | Moran, IV | 431/253 |
| 5,655,901 | 8/1997 | Makoto | 431/153 |
| 5,662,466 | 9/1997 | Cheng | 431/153 |
| 5,697,775 | 12/1997 | Saito et al. | 431/153 |
| 5,704,776 | 1/1998 | Sher | 431/153 |
| 5,738,507 | 4/1998 | Mifune et al. | 431/344 |
| 5,772,423 | 6/1998 | Mandir | 431/254 |
| 5,865,614 | 2/1999 | Hsu | 431/255 |
| 5,897,308 | 4/1999 | Saito et al. | 431/153 |

UTILITY LIGHTER

This application is a division of application Ser. No. 08/787,399, filed Jan. 22, 1997, now U.S. Pat. No. 5,934, 895, Aug. 10, 1999.

TECHNICAL FIELD

The present invention generally relates to general purpose utility lighters such as those used to ignite candles, barbecue grills, fireplaces and campfires.

BACKGROUND OF THE INVENTION

Lighters such as those used for igniting purposes, for example, relying on a fuel container, have developed over a number of years. Typically, these lighters use either a rotary friction element or a piezoelectric element to generate a spark in proximity to a nozzle emitting the fuel. Piezoelectric mechanisms have gained universal acceptance because they are simple to use. One such piezoelectric mechanism is disclosed in U.S. Pat. No. 5,262,697 (the '697 patent). The disclosure of the '697 patent is hereby incorporated by reference herein.

Lighters have also evolved from the small, handheld lighters to several forms of extended lighters also hand held but more useful for general purposes such as lighting candles, barbecue grills, fireplaces and campfires. Earlier attempts at such designs relied simply on extended actuating handles to house a typical lighter at the end. Examples of this concept are found in U.S. Pat. Nos. 4,259,059 and 4,462, 791.

In addition, many current and past general purpose lighters have had some form of shut-off mechanism for resisting undesired operation of the lighter by young children. Often, these mechanisms take the form of on/off switches that may shut off the fuel source or may completely prevent movement of an actuator, such as a push-button, on the lighter. While it is desirable to inhibit certain operation of lighters, such as use by children, it is also desirable to maintain good function. Moreover, the use of on/off switches that must be positively moved by the user between "on" and "off" positions has drawbacks. For example, an adult user may forget to move the switch back to the "off" position after use and thereby allow easier undesired operation by a child.

Further problems are specific to lighters incorporating piezoelectric mechanisms. In particular, to use these mechanisms in extended length lighter devices, wires have normally been required to connect the piezoelectric mechanism to the forward end of the lighter proximate the fuel nozzle. One prior lighter that eliminates the wires typically associated with a piezoelectric mechanism is U.S. Pat. No. 5,154, 601. This lighter places the piezoelectric element proximate the forward end of the lighter with one end of the piezoelectric element in direct contact with the burner or nozzle, while the opposite end is in contact with a tube forming part of a push button assembly. The push button assembly is electrically conductive and, during actuation, slides against a metal housing portion. While this construction does eliminate the use of wires, the design also requires contact between a moving push button and a housing portion to complete the electrical circuit. This contact not only relies on close tolerances during manufacture but, over time, the push button may lose electrical contact with the metal housing portion. This is especially true if wear creates a gap between the push button and the metal housing portion. Moreover, the design requires that the user move the push button in a forward direction rather than a more ergonomic and easily accomplished rearward direction of a trigger or inward direction of a push button.

Thus, there remains a need for a utility lighter that resists unwanted actuation and which minimizes wiring in a more efficient, reliable and ergonomic manner.

SUMMARY OF THE INVENTION

It is therefore one object of this invention to provide a utility lighter, capable of resisting undesired operations, such as by children.

Another object of the invention is to prevent a user from unintentionally storing the lighter in a readily operable condition.

It is has also been an object of this invention to provide an ergonomically and aesthetically pleasing lighter which may also be comfortably operated by one hand.

It has been a further object of this invention to provide a reliable, ergonomically designed lighter while minimizing wiring associated with an electric ignitor assembly, such as a piezoelectric mechanism in the lighter. The reduction in complexity achieved by the invention increases the reliability and longevity of the device.

These objects and advantages as well as other objects and advantages are accomplished in a utility lighter generally including a housing having a handle proximate a first end and a nozzle with an outlet proximate a second end. The housing further includes a fuel supply container connected for selective fluid communication with the nozzle. An ignitor assembly is operatively connected to the housing for generating a spark at the nozzle outlet. An actuating assembly is connected to the housing proximate the handle and is operative to both dispense fuel from the fuel supply and to activate the ignitor assembly. In accordance with one aspect of this invention, a latch member is operatively connected with the handle and includes a blocking portion connected for biased movement relative to the actuating assembly. This blocking portion is normally biased into engagement with the actuating assembly to prevent operative movement thereof. Thus, a user may selectively bias the blocking portion out of engagement with the actuating assembly to permit operation of the actuating assembly, such as through the use of a trigger extending from the handle. While actuating members other than triggers may be used with this invention, it is preferred to use a trigger which may be easily pulled rearwardly or toward the first end of the housing as the user grasps the handle as long as the latch member is disengaged.

The latch member is preferably positioned on the handle such that the latch member may be actuated by one finger of the user to permit movement of the actuating assembly, when another finger on the same hand of the user is on the trigger to actuate the lighter. More specifically, the latch member preferably has a tab mounted for movement into a top portion of the handle, and the trigger extends from a lower front portion of the handle. Therefore, a user may easily grasp the handle and depress the tab with a thumb to release the actuating assembly and then pull the trigger with the index finger of the same hand. The trigger is also normally biased outwardly such that when finger pressure is released, the trigger springs outwardly shutting off the flow of fuel. After which, when the user takes thumb pressure off of the latch member, the actuating assembly is automatically locked into an inoperative state.

The fuel supply container is preferably a conventional container of fuel, such as pressurized butane, having a valve for dispensing the fuel to the nozzle and a valve actuator which may be actuated directly or indirectly by the trigger. A conventional conduit, such as plastic tubing may be used to connect the fuel supply container to the nozzle. In a preferred embodiment, a biased pivoting member is mounted between the trigger and a linking rod. The biased pivoting member is also preferably used to move the valve actuator to open the valve. The linking rod is operatively connected to the ignitor assembly. A preferred ignitor assembly is a piezoelectric mechanism. Other mechanical or electrical ignitor assemblies may be substituted while still realizing one or more advantages of the invention. In the preferred embodiment, the linking rod moves in a direction operable to compress the piezoelectric mechanism which then generates a voltage between a pair of contacts thereof. The latch member includes a hooked tab normally biased to engage a stop member structure on the linking rod and to prevent movement relative to the ignitor assembly until the tab is depressed and disengaged from the stop member structure as discussed above and then the trigger movement can move the rod.

In another aspect of this invention, a portion of the lighter housing is formed of an electrically conductive material and is disposed generally between the first and second ends. The second end of the housing includes first and second electrodes electrically connected to the electric ignitor assembly, e.g., the piezoelectric mechanism. As with the first embodiment, a fuel supply container is connected for selective fluid communication with the nozzle. The electric ignitor assembly is operatively connected to the housing for generating a spark in the spark gap, and includes first and second electrical contacts. The first electrical contact is in contact with the electrically conductive housing and the first contact, while the second contact is electrically connected to the second electrode.

The nozzle preferably forms the second electrode, and the electrically conductive housing portion preferably includes an upstanding tab extending toward the outlet of the nozzle to form the first electrode. A wire leads from the second electrical contact of the electric ignitor assembly to the nozzle. The nozzle is preferably formed of an electrically conductive material, such as metal, and therefore acts as the second electrode. Thus, a spark gap is created between the tab of the conductive housing portion and the nozzle. As stated above, the ignitor assembly is preferably a piezoelectric mechanism constructed according to the '697 patent. Such a piezoelectric mechanism may be advantageously situated in front of the handle with an electrical contact at a forward end thereof abutting against the electrically conductive housing portion away from the tab portion. The electrically conductive housing portion preferably comprises a metal shell extending forwardly from the piezoelectric mechanism to the second end of the housing. An electrically insulating cap is disposed around at least a portion of the nozzle for preventing undesired sparks between the nozzle and the electrically conductive housing portion away from the tab portion, which aligns with the forward end of the nozzle.

In other aspects of this invention, the first end of the housing includes integral recesses on opposite sides of the handle for receiving a hanging member. Also, the fuel supply container may be inserted into the handle during manufacture or during replacement by a user, and an inner surface of the handle is ramped or inclined to move the container toward the second end of the housing upon insertion into the handle. This facilitates correct placement of the forward end of the container and, specifically, the valve and valve actuator thereof with respect to a connector associated with the fuel conduit and with respect to the actuating assembly.

BRIEF DESCRIPTION OF THE DRAWINGS

To facilitate the understanding of the characteristics of this invention, the following drawing figures have been provided, wherein.

DESCRIPTION OF THE PREFERRED EMBODIMENTS

Figure 1:
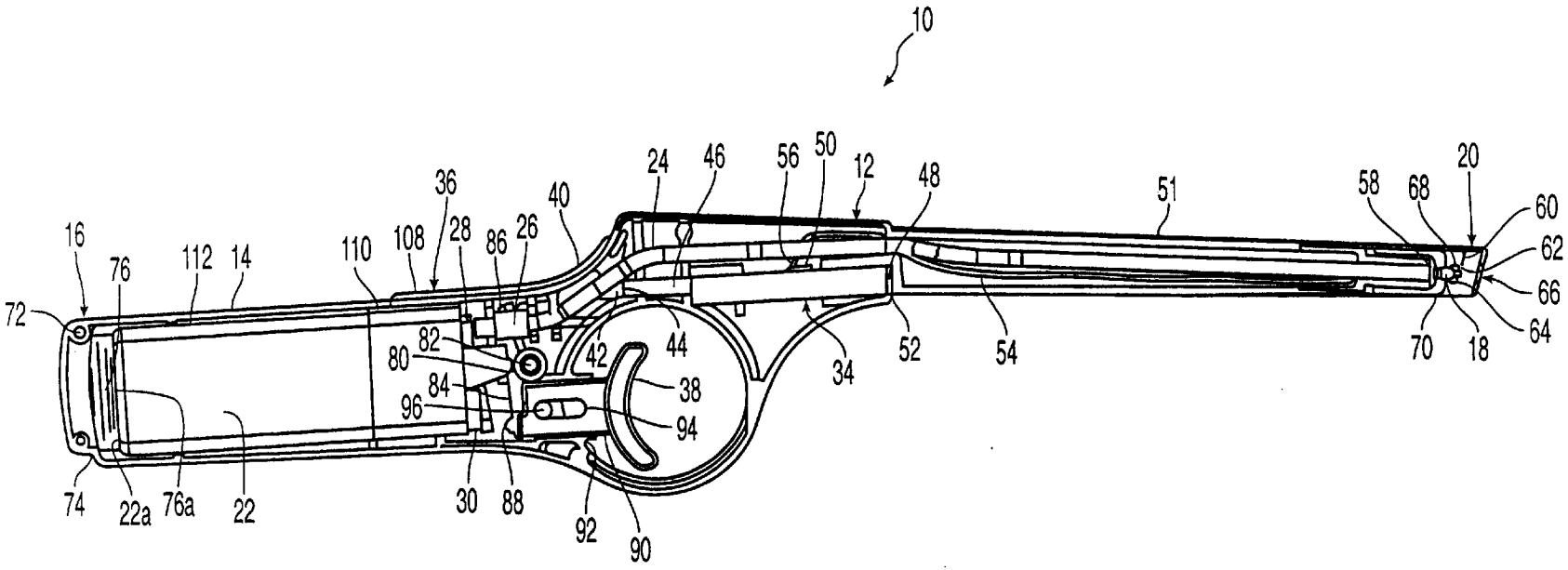
FIG. 1 is a side elevational view of the utility lighter of this invention opened up and with portions in cross-section to show various inner elements thereof.

Turning to FIG. 1, a preferred embodiment of a utility lighter 10 constructed in accordance with the present invention is shown with the understanding that those of ordinary skill in the art will recognize many modifications and substitutions which may be made to various elements. Lighter 10 generally includes a housing 12 which may primarily be formed of a molded rigid polymer or plastic materials such as acrylonitrile, butadiene, styrene terpolymer. Housing 12 includes a handle 14 proximate to a first end 16. A nozzle 18 is disposed at a second end 20 for emitting fuel to feed a flame as will be described herein. Handle 14 preferably contains a fuel supply container 22, which may be a conventional butane fuel cell. A conduit 24, such as a plastic tube, is fixed to a fluid connector 26 and then to a valve 28 on fuel supply container 22. The opposite end of tube 24 connects with nozzle 18. Valve 28 is operated by a valve actuator 30, which is pivotally attached to fuel supply container 22. Thus, when valve actuator 30 is depressed, e.g., moved toward end 16, fuel is released by valve 28 through connector 26 and tube 24 and finally flows to nozzle 18. A suitable fuel supply container 22 is disclosed in U.S. Pat. No. 5,520,197. The disclosure of '197 patent is hereby incorporated by reference herein.

An actuating assembly is provided to facilitate depression of the valve actuator and to simultaneously activate an ignitor assembly 34 for generating a spark proximate nozzle 18. The actuating assembly preferably comprises a trigger member 38, a biased pivoting member 80, and a linking rod 46 operatively connected to the ignitor assembly 34. These components are described in detail below. Although not necessary for all aspects of this invention, an electric ignitor assembly such as a piezoelectric mechanism is the preferred ignitor assembly 34. More specifically, the preferred piezoelectric mechanism is of the type disclosed in the '697 patent, the disclosure of which has been incorporated herein.

Figure 2:
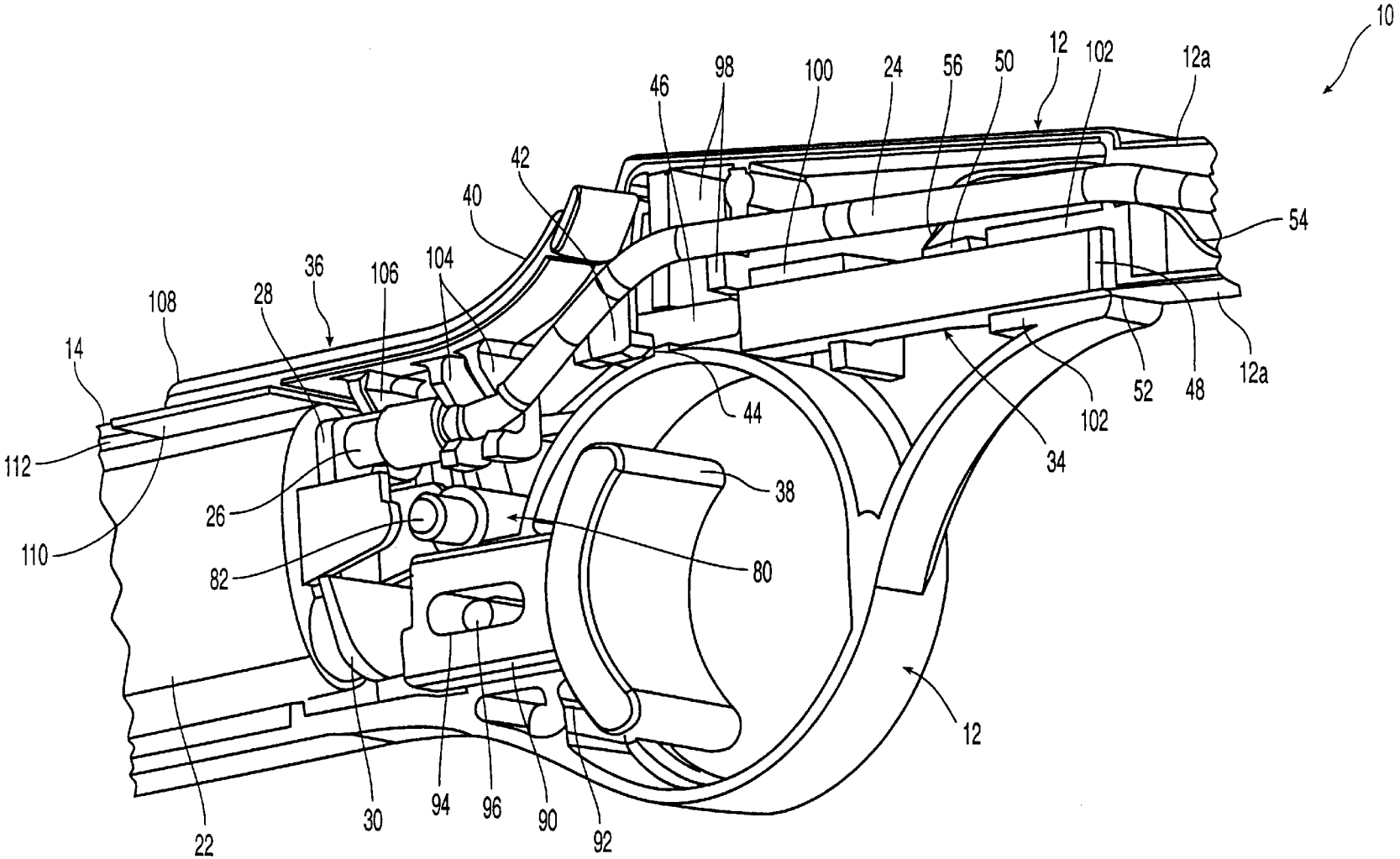
FIG. 2 is an enlarged and partially fragmented perspective view of the lighter shown in FIG. 1 better illustrating various inner details.
Figure 3:
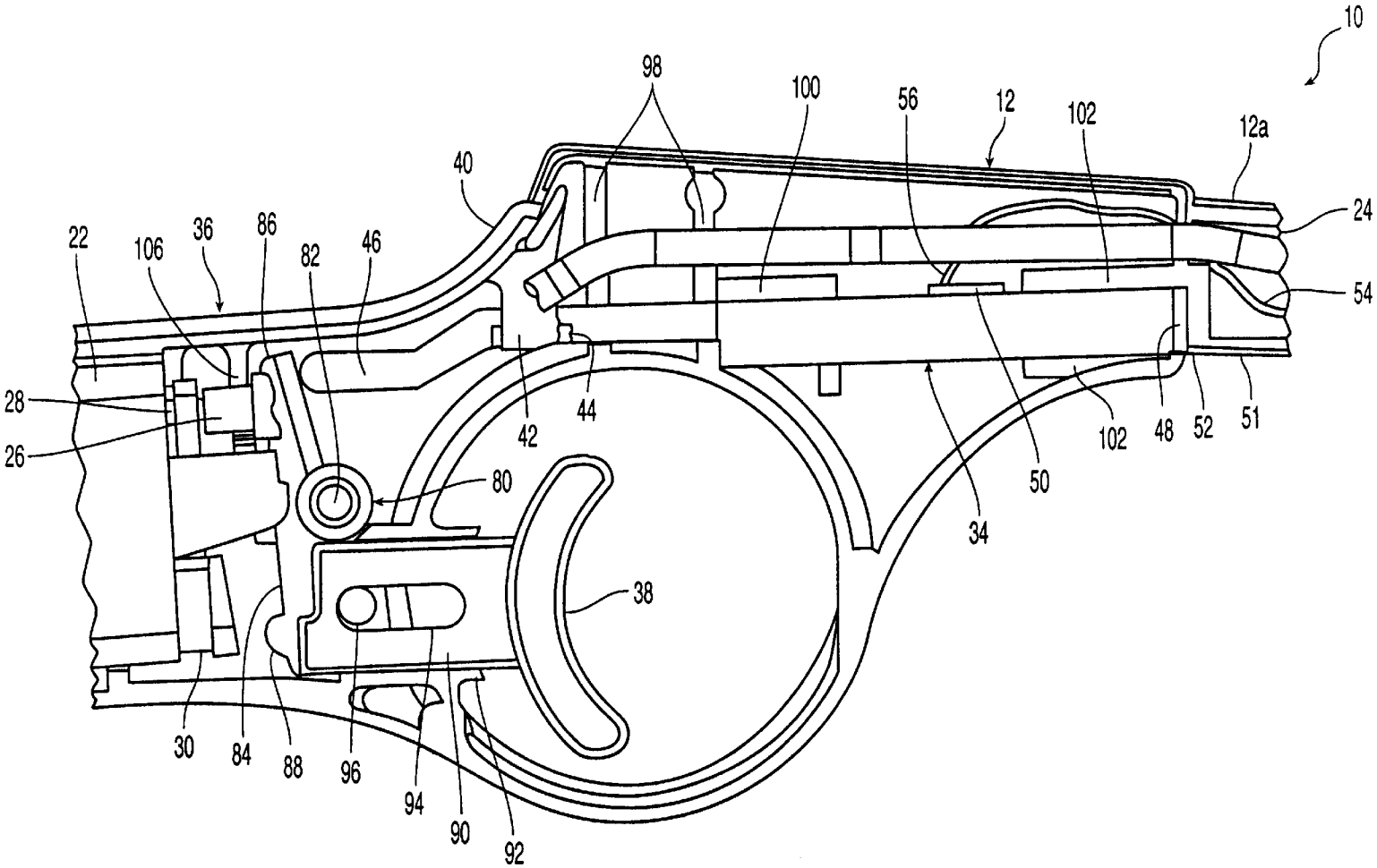
FIG. 3 is an enlarged and partially fragmented side elevational view similar to FIG. 1 but eliminating certain portions to more clearly show the actuating assembly and latch member.

As shown best in FIGS. 2 and 3, a latch member 36 normally locks the actuating assembly in an inoperative position such that a trigger 38 may not be depressed or pulled by a user. As will be discussed further below, latch member 36, as shown in FIGS. 1 and 2, and particularly in FIGS. 3 and 4, generally includes an unsupported resilient front end 40 having an attached hooked tab 42 normally in engagement with stop member structure 44 on a linking rod 46, shown particularly in FIG. 5, associated with actuating assembly. When hooked tab 42 is engaged against stop member structure 44, which may comprise a recess in linking rod 46, linking rod 46 may not be moved in a forward direction to compress and actuate piezoelectric mechanism 34. In the same way, latch member 36 prevents any movement of trigger 38 toward valve actuator 30, which would release fuel from valve 28, therefore fuel release is prevented.

Piezoelectric mechanism 34 has been illustrated in FIGS. 1–3 schematically and particularly described in the '697 patent. The details necessary to an understanding of this invention have been shown in the drawings. In summary, however, piezoelectric mechanism 34 is a telescopic assembly which may be compressed to generate a voltage between first and second electrical contacts 48, 50. Specifically, piezoelectric mechanism 34 contains a piezoelectric crystal in electrical contact with and generally situated between electrical contacts 48, 50. Electrical contact 48 is generally referred to as an anvil and electrical contact 50 contacts an impact pad positioned on an opposite side of the piezoelectric crystal. First electrical contact or-anvil 48 is in direct contact with an electrically conductive shell 51, which is disposed on the outside of a portion of housing 12 at junction location 52, as best illustrated in FIG. 3.

Conductive shell 51 is preferably made out of metal, which may be disposed over a portion of housing 12. Second electrical contact 50 is connected to an insulated wire 54 having two exposed ends 56, 58. Exposed end 56 is connected to contact 50 while exposed end 58 is connected to nozzle 18. Nozzle 18 therefore acts as an electrode and is preferably formed of an electrically conductive metal such as brass or zinc for this purpose.

Conductive shell 51 electrically connects contact 48 at junction 52. At the opposite end, a tab 60 is stamped from shell 51 proximate end 20 to create a spark gap 62 with an outlet 64 of nozzle 18. An opening 66 at the end of conductive shell 51 allows the passage of a flame from the lighter. Also, in a conventional manner, side apertures 68, only one of which is shown in FIG. 1, may be provided to allow the intake of air. Finally, in accordance with another aspect of this invention, an electrically insulating cap 70 is disposed around at least a portion of nozzle 18 and generally between nozzle 18 and conductive shell 51. This electrically insulating cap 70 prevents sparks from being generated between nozzle 18 and any surfaces of conductive shell 51 other than the tab 60.

In another embodiment, conduit 24 may be coextruded with a conductive material along with a plastic material. For example, the plastic material may be extruded on the inside of conduit 24 to conduct fuel gas from fuel supply container 22 to nozzle 18, and a conductive material may be extruded to form the outside of conduit 24. Said conductive exterior would also have exposed ends 56 and 58, connected to contact 50 of piezoelectric element 34 and to nozzle 18, respectively. Alternatively, conduit 24 may be made out of a conductive material without the inner plastic material. Additionally, it may be desirable to coat, by coextruding, an insulating layer outside of the conductive exterior to prevent electrical leakage from the conductive exterior to the surrounding.

Figure 6:
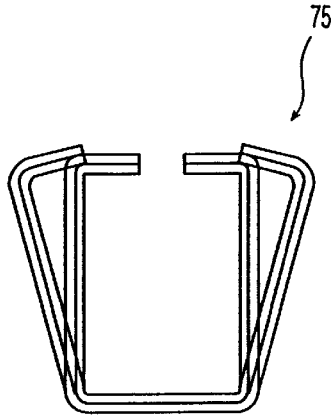
FIG. 6 is a front view of a ring member showing the ing member in the unassembled and assembled positions.

Handle 14 further includes recesses 72 on opposite sides thereof for receiving a ring member 75, having two opposite facing ends, as shown in FIG. 6, suitable for use in hanging lighter 10 during storage. Recesses 72 are preferably integrally formed during the molding process of handle 14 and may be formed either as blind holes, as shown, or through holes in handle 14. The opposite facing ends of ring member 75 are received in recesses 72, as ring 75 is bent inward. Ring 75 is configured and dimensioned to resiliently latch into groove 74 on end 16 of lighter 10, so that ring 75 is tucked away during use.

An internal upstanding surface 76, located at one end of handle 14 is ramped or inclined downwardly and toward second end 20 of housing 12, as shown in FIG. 1. During assembly of lighter 10 or replacement of fuel supply container 22, when container 22 is placed into handle 14 and pushed down, an end surface **22*a* of container 22 rides down ramped surface 76 until a lower locating edge 76*a* thereof abuts end surface 22*a*. Ramped surface 76 pushes fuel container 22 forward, and thereby pushes valve 28 of fuel supply container 22 into connector 26. In this position, valve 28 is securely connected with connector 26, and valve actuator 30** is in the proper position for actuation.

The operation of lighter 10 may be appreciated further from a review of FIGS. 2 and 3. In addition to trigger 38 and linking rod 46, actuating assembly 32 includes a biased pivoting member 80 operatively connected therebetween. Specifically, pivoting member 80 is mounted to a pin 82 in a biased manner, such as through a torsion spring (not shown) placed between member 80 and pin 82 such that member 80 is biased in a counterclockwise direction as viewed in FIGS. 1 and 3. Alternatively, pivoting member 80 may be biased by a return spring disposed within the two telescopic members of piezoelectric mechanism 34 to maintain separation between the telescopic members. Said return spring exerts a biasing force on rod 46 which is in physical contact with pivoting member 80. Such a return spring is disclosed in the '697 patent. In a further alternative, a compressive spring disposed under valve actuator 30 of fuel supply container 22, which exerts a force on valve actuator 30 toward pivoting member 80. Said compressive spring may also bias member 80 in the same manner stated above. Such a compressive spring is disclosed in the '197 patent.

Biased pivoting member 80 further includes a pair of arms 84, 86 generally extending from pin 82. Arm 84 may include a knob 88 for depressing valve actuator 30 when the user pulls trigger 38. Alternatively, a portion of trigger 38 itself may be used to directly engage valve actuator 30. Trigger 38 preferably includes an extension 90 contained thereon a channel 92 for sliding movement relative to housing 12. Extension 90 further includes a slot 94 therewithin, which receives a pin 96 rigidly connected or molded with housing 12. In the position shown in FIG. 3, pin 96 acts as a stop against one end of slot 94 to prevent further forward movement of trigger 38. The opposite end of slot 94 may act as a stop in the other direction. Other types of features that limit forward or rearward movements can be also be used. Arm 86 of pivoting member 80 bears against one end of linking rod 46 as also shown in FIG. 3. Linking rod 46 is supported for sliding movement in forward and rearward directions by suitable support members, such as support members 98 molded into housing 12. Further support members are provided within housing for various purposes, such as support members 100, 102 for holding ignitor assembly or piezoelectric mechanism 34 and support members 104, 106 (also shown in FIG. 4) for respectively holding fuel conduit 24 and connector 26.

Figure 4:
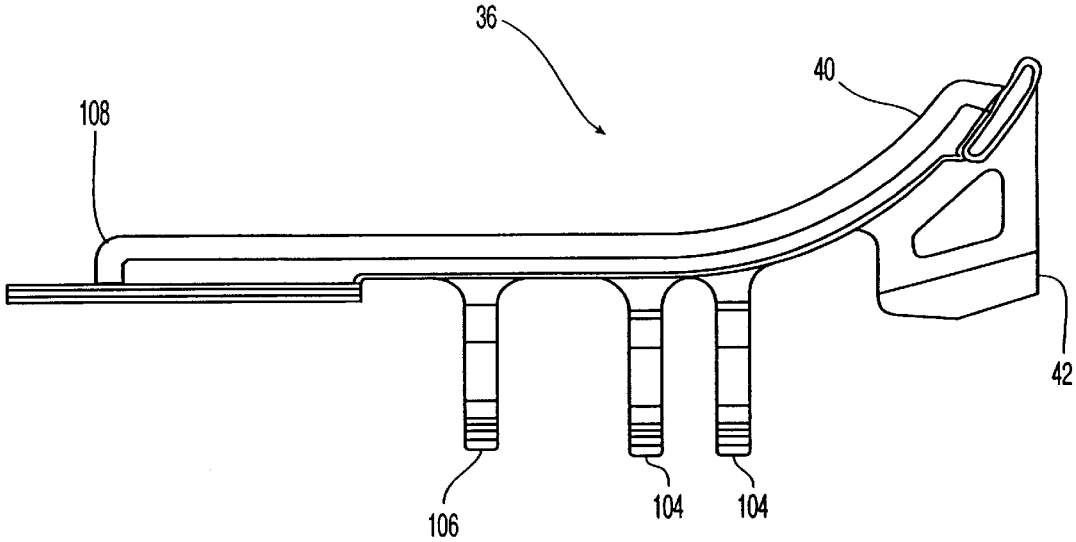
FIG. 4 is a front view of a latch member.
Figure 5:
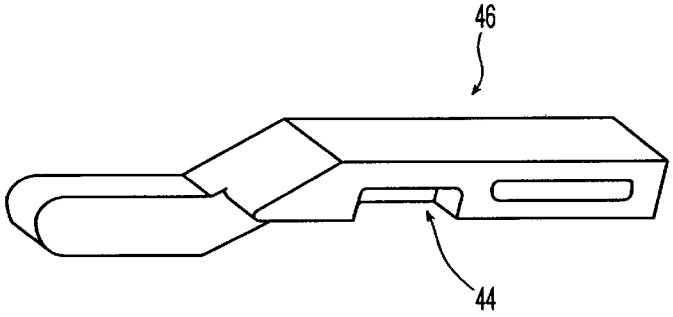
FIG. 5 is a perspective view of a linking rod.

FIGS. 2 and 4 best illustrate the construction and connection of latch member 36 to housing 12. Although other constructions may also be used incorporating other types of resilient members or springs, one design of the construction is a resilient member fixed with a cantilevered connection at one end 108 to handle 14. Specifically, a flange portion 110 fixed to end 108 of latch member 36 is contained within a slot 112 in handle 14. Front end 40 of latch member 36 remains unconnected to housing 12 and may be resiliently depressed downwardly to disengage hooked tab 42 from recess or stop member structure 44 of linking rod 46. It is has been found that latch member 36 may be formed of a polymer that exhibits resiliency or flexure during operation, one such polymer for example is polyacetal.

The operation of lighter 10 will now be described generally with reference to FIG. 1. With one hand, a user grasps handle 14 with the index finger on trigger 38 and the thumb on front end 40 of latch member 36. Depressing and holding down the front end 40 of latch member 36 downwardly disengage hooked tab 42 from linking rod 46 (FIG. 3) and allow full movement of trigger 38. Thereafter, the user can pull trigger 38, which depresses valve actuator 30 thereby releasing fuel from fuel supply container 22 through valve 28, connector 26 and conduit 24. Gaseous fuel, such as butane, is thereby released from nozzle 18 at outlet 64. At the same time, the actuation of trigger 38 rotates arm 86 of spring biased pivot 80 in a clockwise direction against linking rod 46, as will be best understood from FIG. 3. Linking rod 46 moves forward and compresses piezoelectric mechanism 34 to generate a voltage between electrical contacts 48, 50. Electrical current passes from contact 48 into electrically conductive shell 51 and from contact 50 into wire 54 which is connected to electrically conductive nozzle 18. A spark is thereby generated in spark gap 62 to ignite the air/gas mixture in the vicinity of nozzle outlet 64. The resulting flame therefore passes through hole 66. As long as the user depresses front end 40 of latch member 36, the trigger may be repeatedly pulled and the piezoelectric mechanism 34 may be actuated repeatedly in the event that the first actuation does not produce a flame.

When the user releases pressure from trigger 38, spring biased pivot 80 is biased in a counterclockwise position to disengage valve actuator 30, which is also biased in an outward direction, in order to close valve 28 and shut off the supply of fuel to nozzle 18. This extinguishes the flame emitted from hole 66. When the user releases thumb pressure from front end 40 of latch member 36, hooked tab 42 reengages recess or stop member structure 44 on linking rod 46 thus preventing movement of linking rod 46 with respect to ignitor assembly 34 and preventing inward movement of trigger 38. Therefore, as front end 40 of latch member 36 is normally biased in this upward position such that hooked tab 42 engages link member 46, a user cannot inadvertently leave lighter 10 in a state, which trigger 38 may simply be pulled to activate the lighter without again depressing latch member 36. Also, the relative difficulty of operating both the latch member and the trigger essentially at the same time further increases the skills required to operate the lighter.

While the preferred embodiment specifically described herein is considered best able to fulfill the objects and advantages of this invention, it will be appreciated that numerous modifications and additional embodiments may be devised by those skilled in the art, and it is intended that the appended claims cover all such modifications and embodiments that fall within the true spirit and scope of the present invention.

What is claimed is:

1. An utility lighter comprising:

a housing having a handle proximate a first end, a nozzle proximate a second end and an electrically conductive housing portion disposed generally between the first and second ends, the second end of the housing including first and second electrodes forming a spark gap proximate the nozzle, wherein the first electrode is formed by the electrically conductive housing portion, a fuel supply connected for selective fluid communication with the nozzle, an electric ignitor assembly operatively connected to the housing for generating a spark in the spark gap, the electric ignitor assembly being operative to generate a voltage between first and second electrical contacts thereof, the first electrical contact being in contact with the electrically conductive housing portion and the second contact being electrically connected to the second electrode, and an actuating assembly connected to the housing proximate the handle and operative to dispense fuel from the fuel supply to the nozzle and to activate the electric ignitor assembly.

2. The lighter of claim 1 wherein the electric ignitor assembly is a piezoelectric mechanism.

3. The lighter of claim 2 wherein the piezoelectric mechanism has a forward end facing the second end of the housing and the electrically conductive housing portion abuts an electrical contact at the forward end of the piezoelectric mechanism.

4. The lighter of claim 1 wherein the nozzle forms the second electrode.

5. The lighter of claim 4 wherein a wire leads from the piezoelectric mechanism to the nozzle.

6. The lighter of claim 4 wherein the electrically conductive housing portion includes a tab extending toward the nozzle such that a spark gap is formed between the nozzle and the tab.

7. The lighter of claim 1 further comprising an electrically insulating cap disposed around at least a portion of the nozzle for preventing undesired sparks between the nozzle and the electrically conductive housing portion.

8. The lighter of claim 1 further including integral recesses on opposite sides of the handle for receiving a hanging member.

9. The lighter of claim 1 wherein the fuel supply further comprises a container housed in the handle and an inner surface of the handle is ramped to move the container toward the second end of the housing upon insertion into the handle.

10. The lighter of claim 1 wherein the actuating assembly includes a trigger extending from the handle and operating to actuate the ignitor assembly when pulled toward the first end of the housing.

11. The lighter of claim 1 wherein the electrically conductive housing portion is formed as a metal shell encasing a plastic substructure.

* * * * *